US012527376B2

(12) United States Patent
Kim et al.

(10) Patent No.: US 12,527,376 B2
(45) Date of Patent: Jan. 20, 2026

(54) HELMET

(71) Applicant: HJC CORP., Gyeonggi-do (KR)

(72) Inventors: Sung Kwang Kim, Gyeonggi-do (KR); Jung Hyun Jo, Seoul (KR)

(73) Assignee: HJC CORP., Gyeonggi-do (KR)

( * ) Notice: Subject to any disclaimer, the term of this patent is extended or adjusted under 35 U.S.C. 154(b) by 0 days.

(21) Appl. No.: 18/840,680

(22) PCT Filed: Dec. 6, 2022

(86) PCT No.: PCT/KR2022/019659

§ 371 (c)(1),
(2) Date: Aug. 22, 2024

(87) PCT Pub. No.: WO2023/163338

PCT Pub. Date: Aug. 31, 2023

(65) Prior Publication Data

US 2025/0176653 A1 Jun. 5, 2025

(30) Foreign Application Priority Data

Feb. 24, 2022 (KR) ..... 10-2022-0024065

(51) Int. Cl.
*A42B 3/20* (2006.01)
*A42B 3/32* (2006.01)

(52) U.S. Cl.
CPC ..... *A42B 3/205* (2013.01); *A42B 3/326* (2013.01)

(58) Field of Classification Search
CPC ..... A42B 3/205; A42B 3/20; A42B 3/326
USPC ..... 2/410
See application file for complete search history.

(56) References Cited

U.S. PATENT DOCUMENTS

| | | | | |
|---|---|---|---|---|
| 5,483,699 | A | 1/1996 | Pernicka | |
| 6,237,161 | B1 * | 5/2001 | Lee | A42B 3/326 2/424 |
| 11,564,437 | B2 | 1/2023 | Letendre | |
| 2017/0224043 | A1 | 8/2017 | Bouchard-Fortin | |
| 2017/0367432 | A1 * | 12/2017 | Handfield | A42B 3/326 |
| 2021/0227919 | A1 * | 7/2021 | Morgan | A42B 3/166 |

FOREIGN PATENT DOCUMENTS

| | | |
|---|---|---|
| EP | 0972461 | 1/2000 |
| KR | 1020140001141 | 1/2014 |
| KR | 1020140063677 | 5/2014 |

* cited by examiner

*Primary Examiner* — Timothy K Trieu
(74) *Attorney, Agent, or Firm* — DUANE MORRIS LLP; Gregory M. Lefkowitz; Daniel J. Tarr

(57) ABSTRACT

The present disclosure relates to a helmet, and the helmet according to an embodiment of the present disclosure includes a chin curtain (100) disposed at a chin guard (20) of a helmet body (10), wherein the chin curtain (100) rotates with respect to the chin guard (20).

18 Claims, 10 Drawing Sheets

HELMET

CROSS-REFERENCE TO RELATED APPLICATIONS

This application is a § 371 national stage entry of International Application No. PCT/KR2022/019659, filed on Dec. 6, 2022, which claims priority to Korean Patent Application No. 10-2022-0024065, filed on Feb. 24, 2022, the entire contents of which are incorporated herein by reference.

TECHNICAL FIELD

The present disclosure relates to a helmet.

BACKGROUND ART

In general, it is mandatory to wear a helmet while driving a two wheeled vehicle with high speed to protect the wearer's head. The helmet has a front open portion to ensure the wearer's frontal field of view. The helmet may include a shield that can selectively open and close the open portion to keep out wind, dust, etc. while driving.

Meanwhile, the conventional helmet includes a chin guard to protect the wearer's chin as disclosed in the patent literature of the related literatures described below. In this instance, the chin guard may rotate between a closed position and an open position, and when the chin guard is in the closed position, wind may go into the helmet through an empty space between the chin guard and the wearer's chin or neck. To prevent this, in general, a chin curtain is attached to the bottom of the chin guard to cover the empty space between the chin guard and the wearer's chin or neck. However, when the chin guard rotates, the chin curtain comes into contact with the wearer's body (for example, nose), causing inconvenience.

Additionally, even in a full face helmet in which the chin guard does not rotate, when the wearer puts on and takes off the helmet, the chin curtain may come into contact with the wearer's body (for example, nose), causing inconvenience.

RELATED LITERATURES

Patent Literature (Patent Literature 1) KR10-2014-0001141 A

DISCLOSURE

Technical Problem

The present disclosure is designed to solve the above-described problem, and an aspect of the present disclosure is directed to providing a helmet in which a chin curtain rotates with respect to a chin guard, thereby preventing the chin curtain from coming into contact with a wearer's body (for example, nose).

Technical Solution

A helmet according to an embodiment of the present disclosure includes a chin curtain disposed at a chin guard of a helmet body, wherein the chin curtain rotates with respect to the chin guard.

Additionally, in the helmet according an embodiment of the present disclosure, the chin guard is rotatably coupled to the helmet body, and when the chin guard rotates from a closed position to an open position, the chin curtain rotates in a downward direction with respect to the chin guard.

Additionally, in the helmet according an embodiment of the present disclosure, the chin curtain includes a main body rotatably coupled to the chin guard around a rotation axis, and a controller to rotate the main body in the downward direction when the chin guard rotates from the closed position to the open position.

Additionally, in the helmet according an embodiment of the present disclosure, the controller includes an elastic member to provide an elastic force to the main body to rotate the main body in the downward direction when the chin guard rotates from the closed position to the open position, and a rotation control member to rotate the main body in an upward direction when the chin guard rotates to the closed position.

Additionally, in the helmet according an embodiment of the present disclosure, when the chin guard rotates to the closed position, the rotation control member comes into contact with an outer surface of the helmet body and rotates the main body in the upward direction.

Additionally, in the helmet according an embodiment of the present disclosure, the rotation control member is rotatably coupled to the chin guard around a first control axis, and when the chin guard rotates to the closed position, one side of the rotation control member comes into contact with an outer surface of the helmet body, and the other side of the rotation control member is rotatably coupled to the main body around a second control axis to rotate the main body.

Additionally, in the helmet according an embodiment of the present disclosure, the first control axis is disposed between one side and the other side of the rotation control member.

Additionally, in the helmet according an embodiment of the present disclosure, when the chin guard rotates to the closed position, one side of the rotation control member comes into contact with the outer surface of the helmet body and moves in the downward direction, and the other side of the rotation control member moves in the upward direction to rotate the main body in the upward direction.

Additionally, the helmet according an embodiment of the present disclosure further includes a stopper to limit a rotation angle of the rotation control member.

Additionally, in the helmet according an embodiment of the present disclosure, the main body is formed in an arc shape.

Additionally, in the helmet according an embodiment of the present disclosure, the main body is rotatably coupled to a center of the chin guard, and the rotation control member is rotatably coupled to a location away from the center of the chin guard, and is rotatably coupled to an end of the main body.

The features and advantages of the present disclosure will be apparent from the following detailed description in accordance with the accompanying drawings.

Prior to the description, it should be understood that the terms or words used in the specification and the appended claims should not be construed as limited to general and dictionary meanings, but rather interpreted based on the meanings and concepts corresponding to the technical spirit of the present disclosure on the basis of the principle that the inventor is allowed to define terms appropriately for the best explanation.

Advantageous Effects

According to the present disclosure, as the chin curtain rotates with respect to the chin guard, it may be possible to prevent the chin curtain from coming into contact with the wearer's body (for example, nose).

BEST MODE

The objectives, particular advantages and new features of the present disclosure will be apparent from the following detailed description and exemplary embodiments in association with the accompanying drawings. In affixing the reference numbers to the elements of each drawing in the present disclosure, it should be noted that identical elements are given as identical numbers as possible although they are depicted in different drawings. Additionally, the terms such as "first", "second" or the like are used to distinguish one element from another, and the elements are not limited by the terms. Hereinafter, in describing the present disclosure, when it is determined that a certain description of related known technology may unnecessarily obscure the subject matter of the present disclosure, the detailed description is omitted.

Hereinafter, exemplary embodiments of the present disclosure will be described in detail with reference to the accompanying drawings.

Figure 1A:
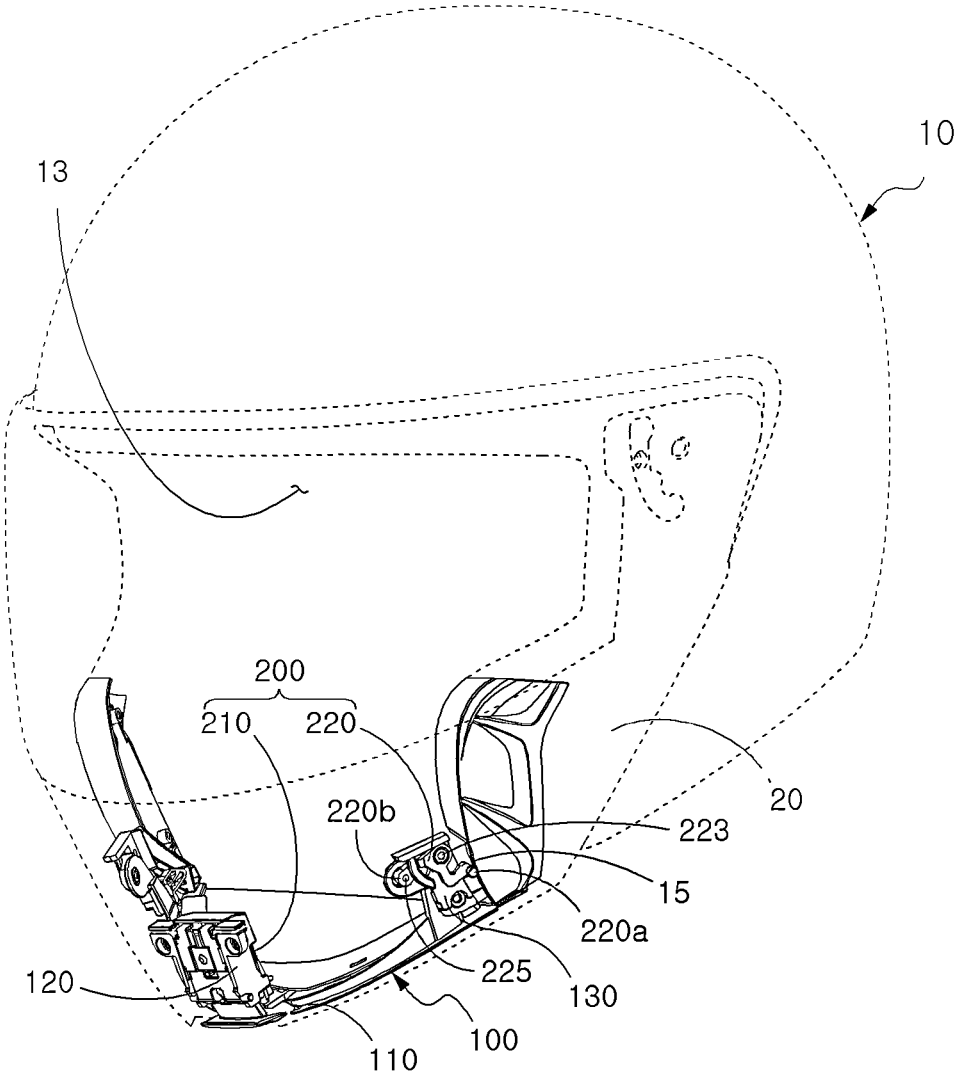
FIGS. 1A and 1B are perspective views of a helmet according to an embodiment of the present disclosure.
Figure 1B:
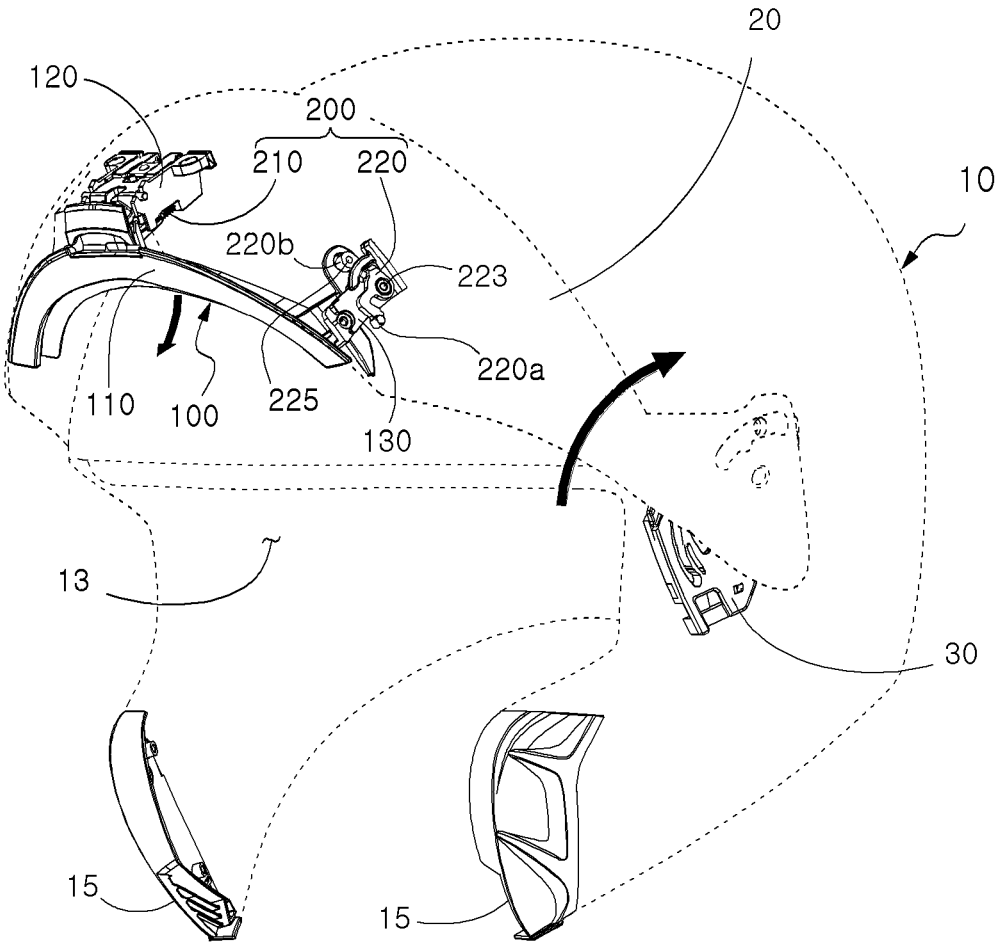
Figure 2:
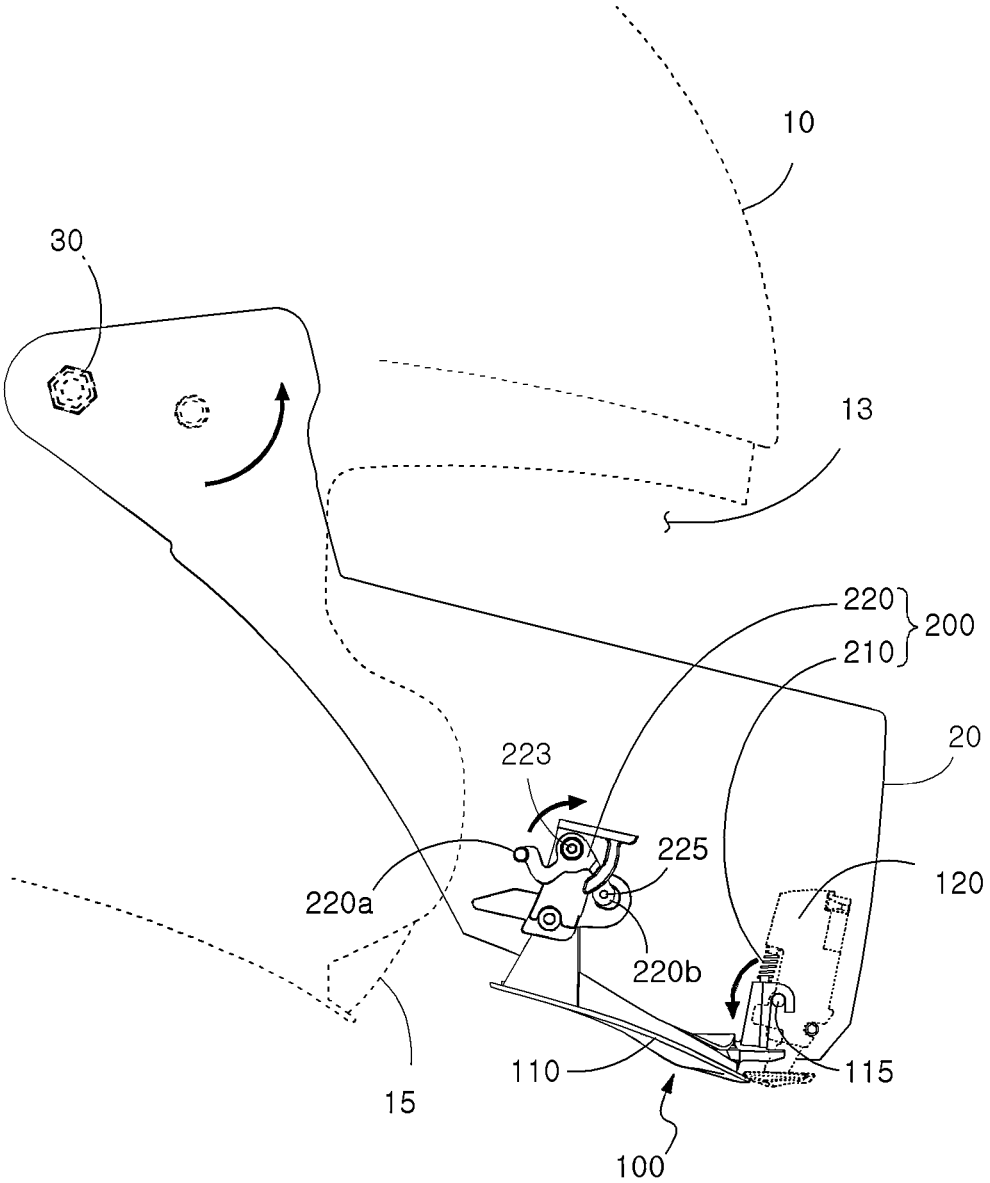
FIGS. 2 and 3 are side views of a helmet according to an embodiment of the present disclosure.
Figure 3:
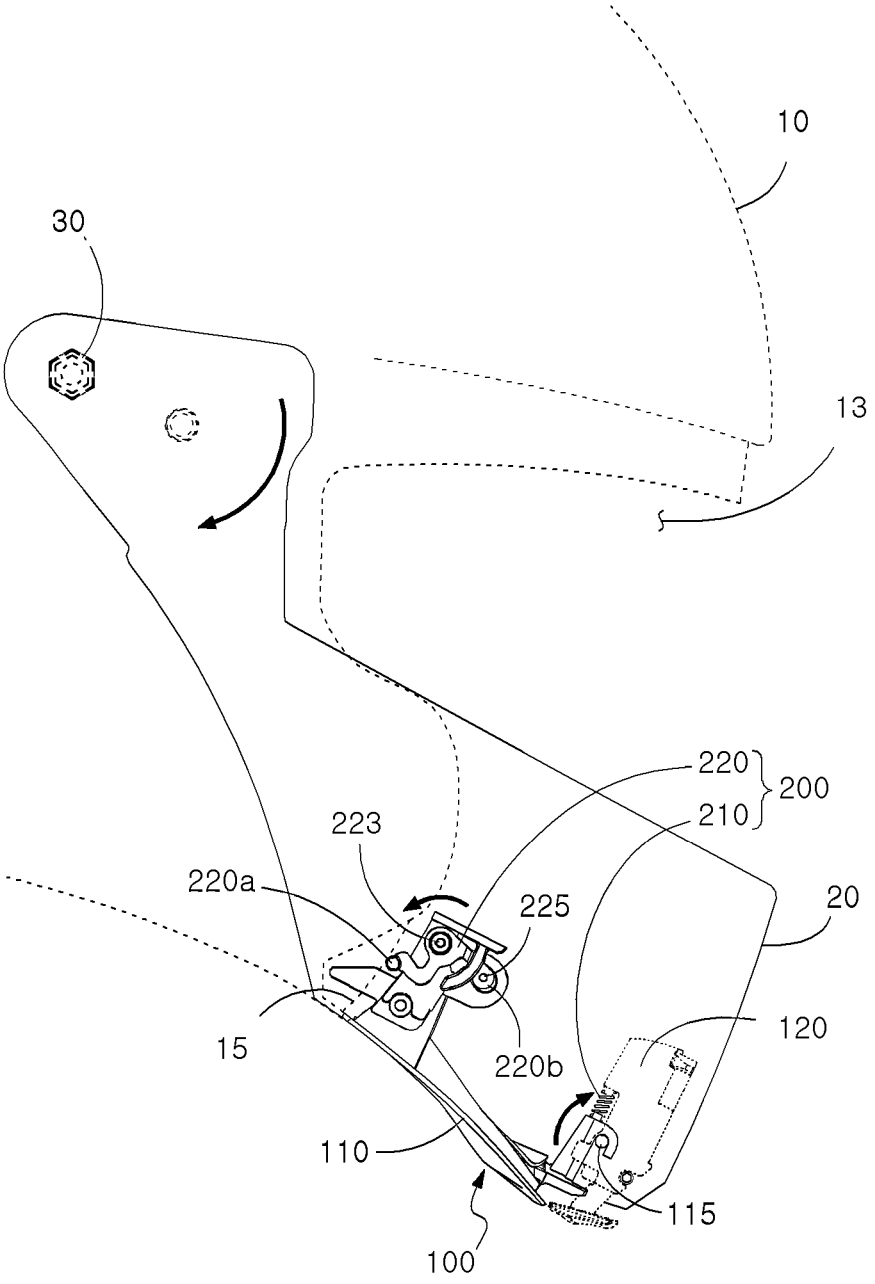

FIGS. 1A and 1B are perspective views of a helmet according to an embodiment of the present disclosure, and FIGS. 2 and 3 are side views of the helmet according to an embodiment of the present disclosure.

As shown in FIGS. 1A to 3, the helmet according to an embodiment of the present disclosure includes a chin curtain 100 disposed at a chin guard 20 of a helmet body 10, and the chin curtain 100 rotates with respect to the chin guard 20.

Basically, the helmet body 10 plays a role in protecting a wearer's head. The helmet body 10 may be made of a shock absorbing material. For example, the helmet body 10 may include an outer shell of hard synthetic resin and having high strength, and an absorber disposed in the outer shell, made of an expanded polystyrene (EPS) foam and having proper strength and elasticity. A pad may be present inside the absorber to improve a snug fit.

Additionally, the chin guard 20 plays a role in protecting the wearer's chin, and may be extended in such an arc shape as a whole that it is disposed in front of the wearer's chin. In this instance, the chin guard 20 is rotatable from a first predetermined position to a second predetermined position with two ends rotatably coupled to two sides (for example, a ratchet 30) of the helmet body 10. For example, the first predetermined position refers to a position when the chin guard 20 is disposed in front of the wearer's chin and may be defined as a closed position (see FIG. 1A). Additionally, the second predetermined position refers to a position when the chin guard 20 is disposed above the helmet body 10 and may be defined as an open position (see FIG. 1B). However, the chin guard 20 is not limited merely to be rotatable from the closed position (the first predetermined position) to the open position (the second predetermined position), and may be disposed at the rear of the helmet body 10.

The chin curtain 100 is disposed on bottom of the chin guard 20 to cover an empty space near the wearer's chin or neck. Here, when the chin guard 20 rotates from the closed position to the open position, the chin curtain 100 rotates in the downward direction with respect to the chin guard 20. Specifically, when the chin guard 20 is in the closed position (see FIG. 1A), the chin curtain 100 is disposed in the right position to cover the empty space between the chin guard 20 and the wearer. In contrast, when the chin guard 20 rotates from the closed position to the open position (see FIG. 1B), the chin curtain 100 rotates in the downward direction (in this instance, the direction in which the chin guard 20 rotates and the direction in which the chin curtain 100 rotates may be the same (for example, counterclockwise direction)). Accordingly, while the chin guard 20 rotates from the closed position to the open position, the distance between the chin curtain 100 and the wearer increases, thereby preventing the chin curtain 100 from coming into contact with the wearer's body (for example, nose).

Here, the chin curtain 100 may include a main body 110 and a controller 200. In this instance, the main body 110 is rotatably coupled to the chin guard 20 around a rotation axis 115 (see FIG. 2). Additionally, when the chin guard 20 rotates from the closed position to the open position, the controller 200 rotates the main body 110 in the downward direction. That is, when the chin guard 20 rotates from the closed position to the open position, the main body 110 is configured to substantially rotate and go away from the wearer, and when the chin guard 20 rotates from the closed position to the open position, the controller 200 plays a role in rotating the main body 110.

Specifically, the controller 200 may include an elastic member 210 and a rotation control member 220. As shown in FIG. 2, when the chin guard 20 rotates from the closed position to the open position, the elastic member 210 provides an elastic force to the main body 110 to rotate the main body 110 in the downward direction. That is, the elastic member 210 provides the force to substantially rotate the main body 110 in the downward direction. Additionally, as shown in FIG. 3, when the chin guard 20 rotates to the closed position, the rotation control member 220 rotates the main body 110 in the upward direction. That is, when the chin guard 20 rotates to the closed position, the rotation control member 220 plays a role in rotating the chin curtain 100 rotated in the downward direction to the right position (upward direction). Specifically, when the chin guard 20 rotates to the closed position, the rotation control member 220 may contact an outer surface 15 of the helmet body 10, and rotate the main body 110 in the upward direction. Here, the outer surface 15 of the helmet body 10 with which the rotation control member 220 comes into contact may be, for example, an outer surface 15 of a protruding portion disposed at the lower side of an open portion 13 formed at the front side of the helmet body 10. More specifically, the rotation control member 220 is rotatably coupled to the chin guard 20 around a first control axis 223, and when the chin guard 20 rotates to the closed position, may rotate with one side (a first end 220*a*) in contact with the outer surface 15 of the helmet body 10. In this instance, as the other side (a second end 220*b*) is rotatably coupled to the main body 110 around a second control axis 225, the rotation control member 220 may rotate the main body 110. Here, the first control axis 223 is disposed between one side (the first end 220*a*) and the other side (the second end 220*b*) of the rotation control member 220. Accordingly, when the chin guard 20 rotates to the closed position, as the rotation control member 220 rotates around the first control axis 223 with one side (the first end 220*a*) of the rotation control member 220 in contact with the outer surface 15 of the helmet body 10, one side (the first end 220*a*) of the rotation control member 220 moves in the downward direction, and the other side (the second end 220*b*) of the rotation control member 220 moves in the upward direction. As described above, as the other side (the second end 220*b*) of the rotation control member 220 moves in the upward direction, the main body 110 coupled to the other side (the second end 220*b*) of the rotation control member 220 may also rotate in the upward direction.

Meanwhile, the detailed structure of the main body 110, the elastic member 210 and the rotation control member 220 and their connection relationship will be described. Here, the main body 110 may be formed in an arc shape as a whole to conform to the shape of the bottom of the chin guard 20 (see FIG. 1B). In this instance, the main body 110 may be rotatably coupled to the bottom of the center of the chin guard 20. As shown in FIG. 2, the main body 110 may be coupled to a first bracket 120 disposed inside of the center of the chin guard 20 through the rotation axis 115. Additionally, the elastic member 210 may be disposed at the space between the main body 110 and the first bracket 120 (above the rotation axis 115). In this instance, the elastic member 210 is not limited to a particular type, but may be, for example, a compression spring. On the other hand, as shown in FIG. 1A, the rotation control member 220 may be rotatably coupled to a location away from the center of the chin guard 20. For example, one rotation control member 220 may be disposed at each of the left and right sides on the inner side of the chin guard 20, totaling two rotation control members 220. Specifically, the rotation control member 220 may be rotatably coupled to a second bracket 130 disposed inside of the chin guard 20 through the first control axis 223. On the other hand, the rotation control member 220 may be rotatably coupled to the end of the main body 110 through the second control axis 225. Additionally, one side (the first end 220*a*) of the rotation control member 220 may be formed in a curved shape to slide in contact with the outer surface 15 of the helmet body 10. For example, one side (the first end 220*a*) of the rotation control member 220 may be cylindrical in shape.

Figure 4:
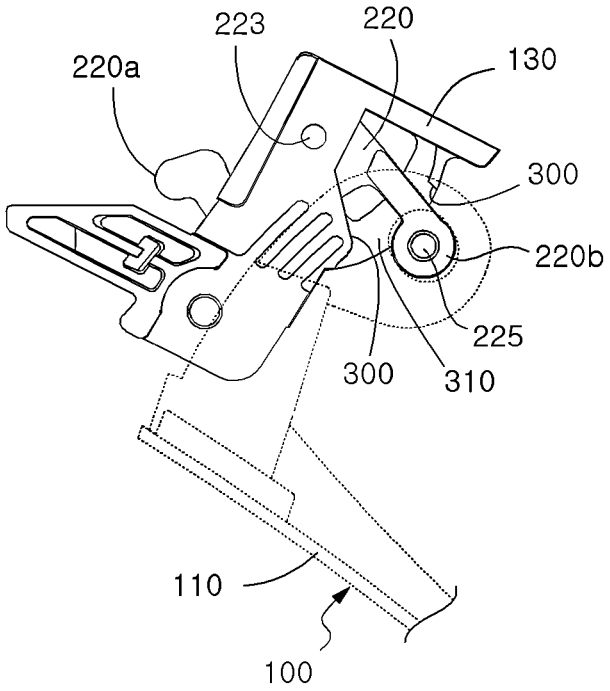
FIG. 4 is an enlarged side view of a rotation control member of a helmet according to an embodiment of the present disclosure.

In addition, as shown in FIG. 4, a stopper 300 may be used to limit the rotation angle of the rotation control member 220. Here, the stopper 300 plays a role in limiting the angle at which the rotation control member 220 rotates within a predetermined range, and as the angle at which the rotation control member 220 rotates is limited by the stopper 300, the movement range of the other side (the second end 220*b*) of the rotation control member 220 coupled to the main body 110 may be limited, and as a result, the rotation angle of the main body 110 coupled to the other side (the second end 220*b*) of the rotation control member 220 may be also limited within the predetermined range. Specifically, a guide portion 310 may be formed in the second bracket 130 to which the rotation control member 220 is coupled, so as to guide the rotation of the rotation control member 220 when it contacts the rotation control member 220, and the stopper 300 may be stepped at two ends of the guide portion 310.

MODE FOR INVENTION

FIGS. 5 to 8 are side views showing an operation process of the helmet according to an embodiment of the present disclosure, and the operation process of the chin curtain 100 according to this embodiment will be described with reference to FIGS. 5 to 8.

Figure 5:
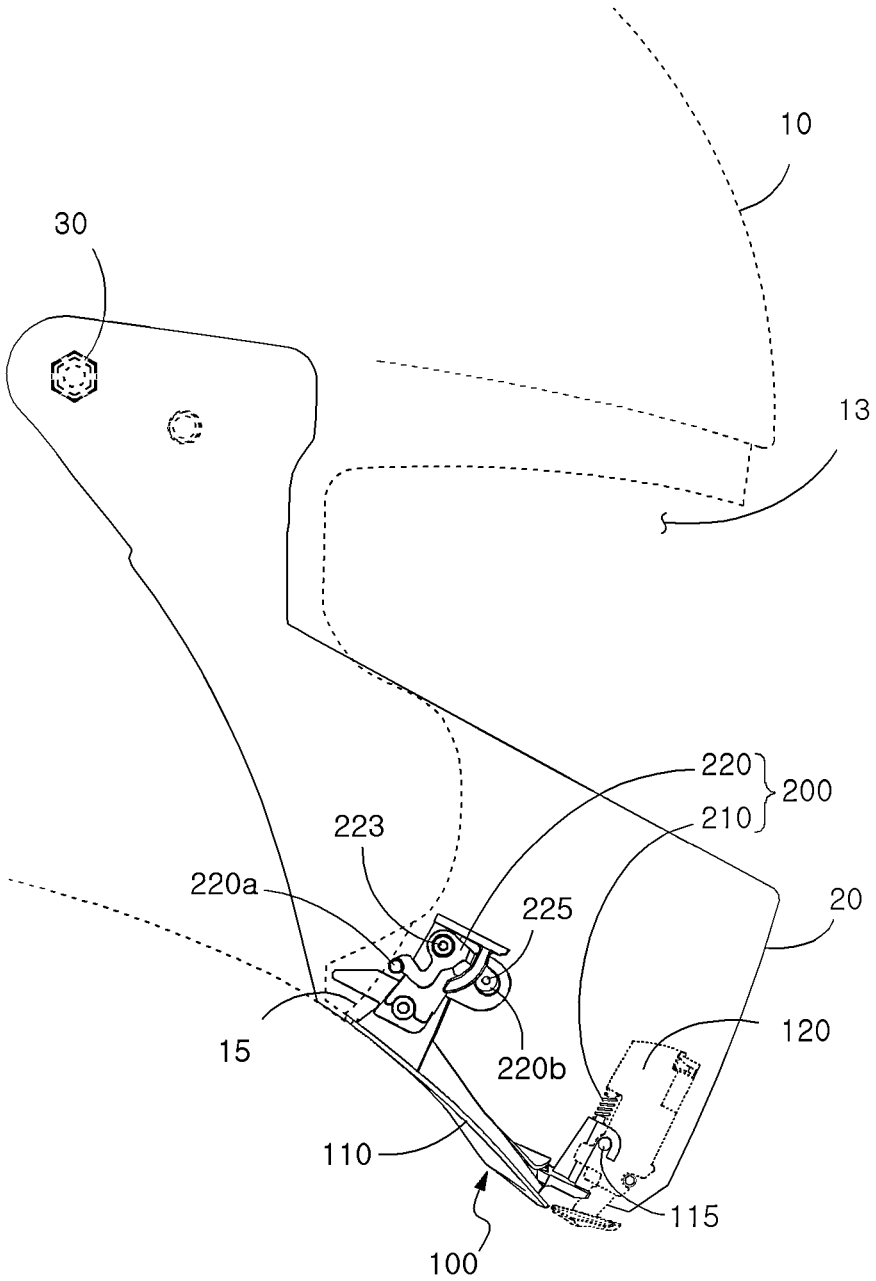
FIGS. 5 to 8 are side views showing an operation process of a helmet according to an embodiment of the present disclosure.

To begin with, as shown in FIG. 5, when the chin guard 20 is in the closed position, one side (the first end 220*a*) of the rotation control member 220 contacts the outer surface 15 of the helmet body 10, and one side (the first end 220*a*) is disposed in the relatively downward direction, and the other side (the second end 220*b*) is disposed in the relatively upward direction. In this instance, as the main body 110 coupled to the other side (the second end 220*b*) of the rotation control member 220 is also disposed the relatively upward direction, the main body 110 may be disposed in the right position to cover the empty space between the chin guard 20 and the wearer. Additionally, as the main body 110 is disposed in the relatively upward direction, the elastic member 210 is compressed between the main body 110 and the first bracket 120, and in this instance, the elastic force of the elastic member 210 is provided to the main body 110 in the downward direction.

Figure 6:
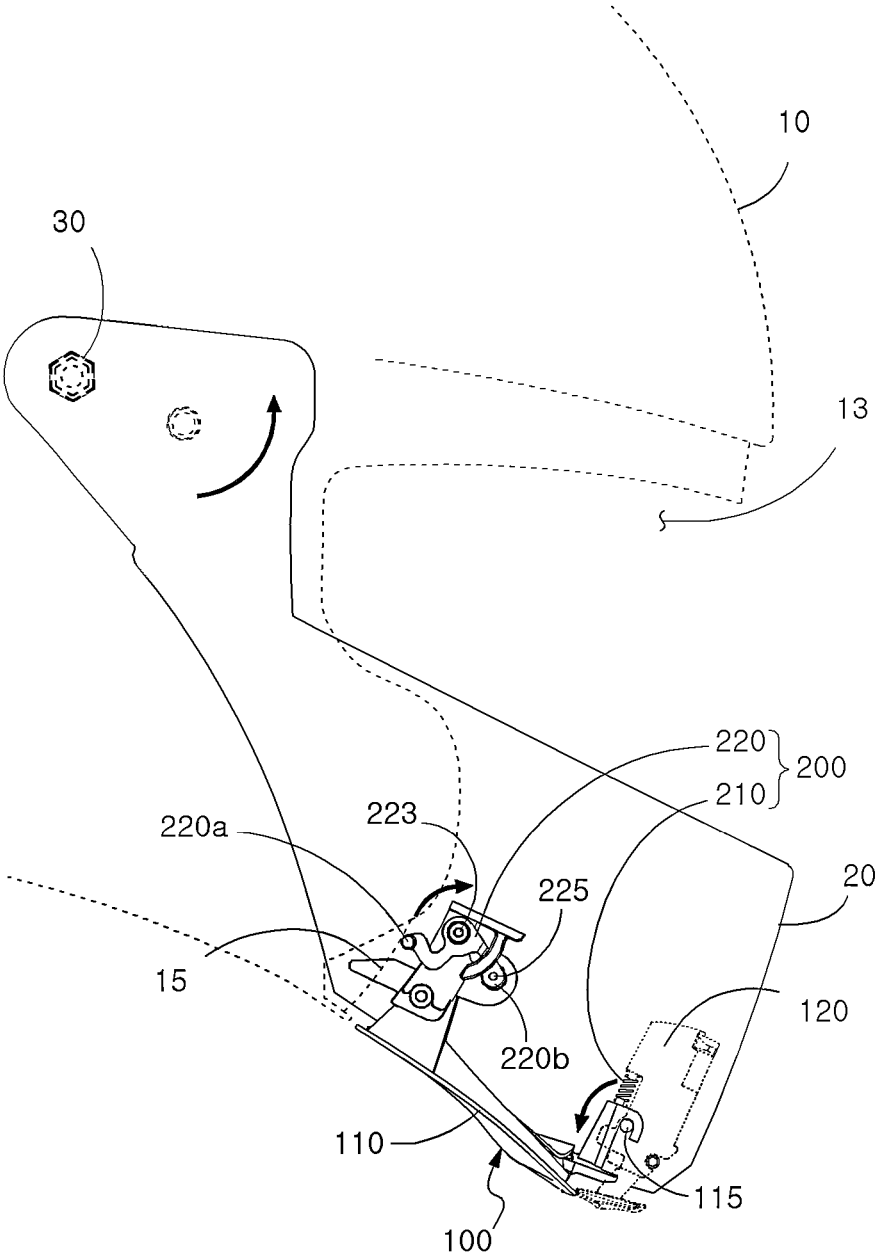
Figure 7:
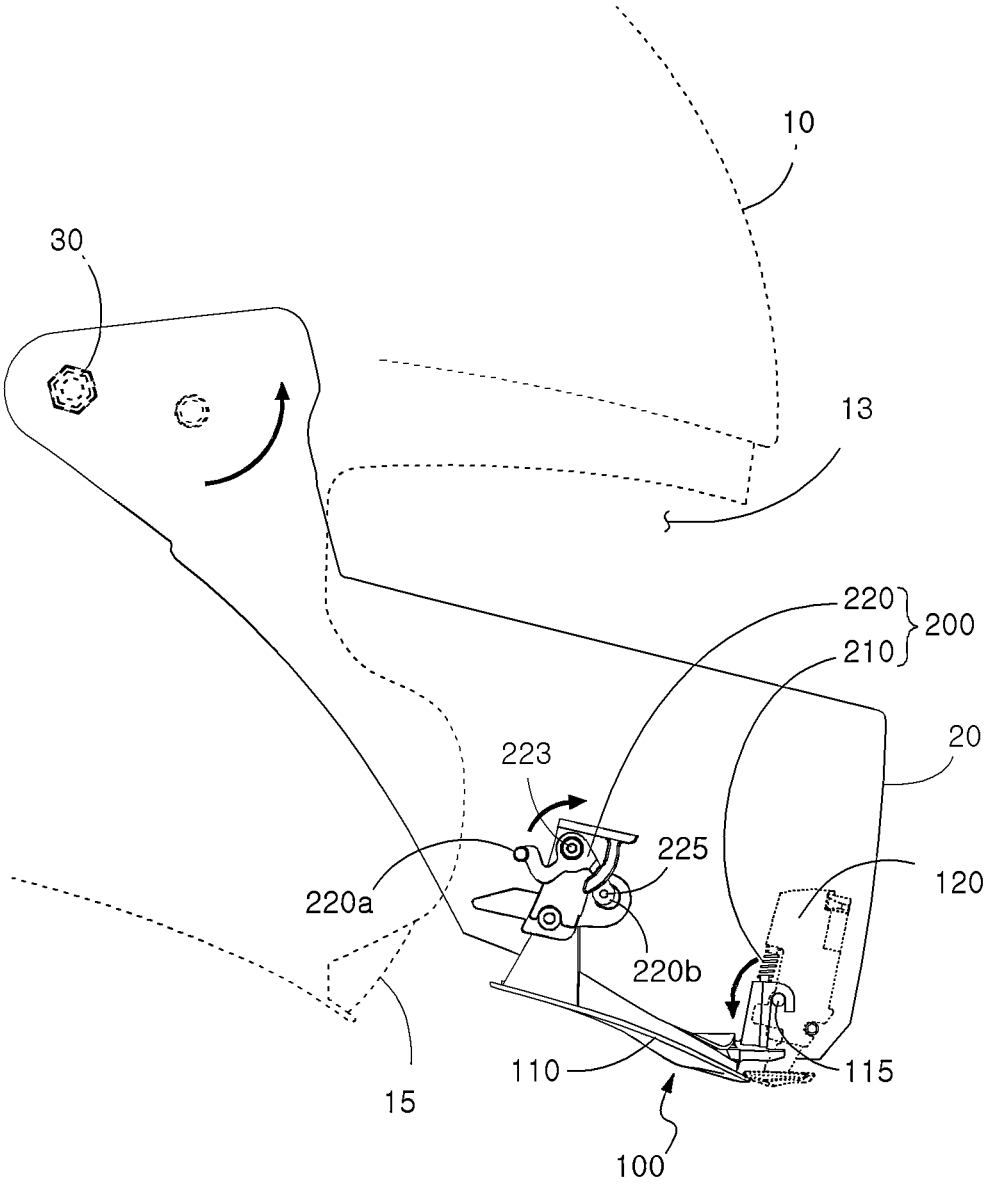

Subsequently, as shown in FIGS. 6 and 7, when the chin guard 20 rotates from the closed position to the open position, the rotation control member 220 slides with one side (the first end 220*a*) in contact with the outer surface 15 of the helmet body 10, and goes away from the outer surface 15 of the helmet body 10. In this instance, as the rotation control member 220 rotates around the first control axis 223, one side (the first end 220*a*) moves in the upward direction, and the other side (the second end 220*b*) moves in the downward direction. At the same time, the main body 110 coupled to the other side (the second end 220*b*) of the rotation control member 220 may rotate around the rotation axis 115 in the downward direction by the elastic force of the elastic member 210. In this instance, the direction in which the main body 110 rotates may be the same as the direction in which the chin guard 20 rotates (for example, counterclockwise direction) and opposite to the direction in which the rotation control member 220 rotates (for example, clockwise direction). As described above, as the main body 110 rotates in the downward direction, the distance between the chin curtain 100 and the wearer increases, thereby preventing the chin curtain 100 from coming into contact with the wearer's body (for example, nose).

Figure 8:
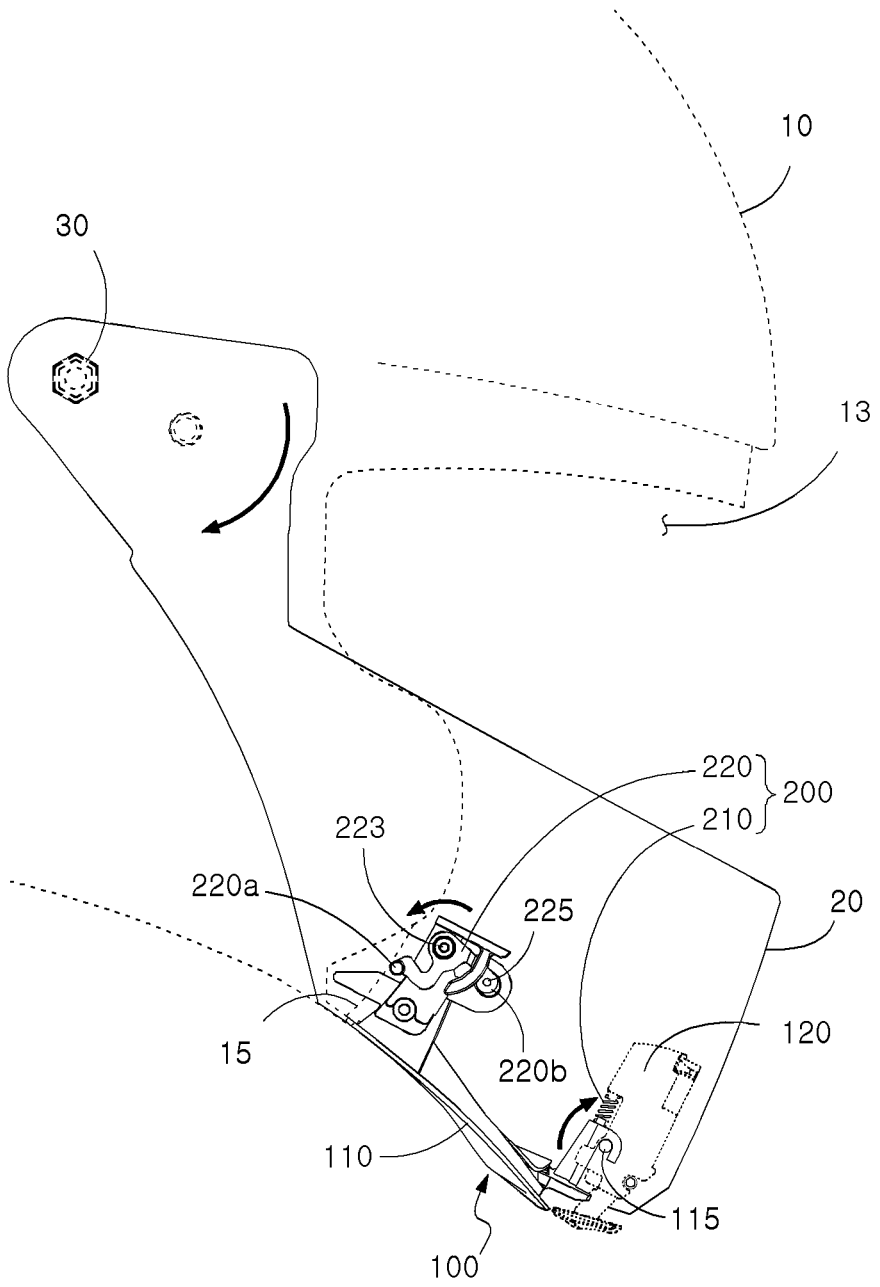

Subsequently, as shown in FIG. 8, when the chin guard 20 rotates to the closed position, as the rotation control member 220 rotates around the first control axis 223 with one side (the first end 220*a*) in contact with the outer surface 15 of the helmet body 10, one side (the first end 220*a*) moves in the downward direction, and the other side (the second end 220*b*) moves in the upward direction. As described above, as the other side (the second end 220*b*) of the rotation control member 220 moves in the upward direction, the main body 110 coupled to the other side (the second end 220*b*) of the rotation control member 220 may rotate around the rotation axis 115 in the upward direction. Accordingly, the main body 110 may be disposed in the right position to cover the empty space between the chin guard 20 and the wearer. In this instance, the direction in which the main body 110 rotates may be the same as the direction in which the chin guard 20 rotates (for example, clockwise direction) and opposite to the direction in which the rotation control member 220 rotates (for example, counterclockwise direction).

Figure 9:
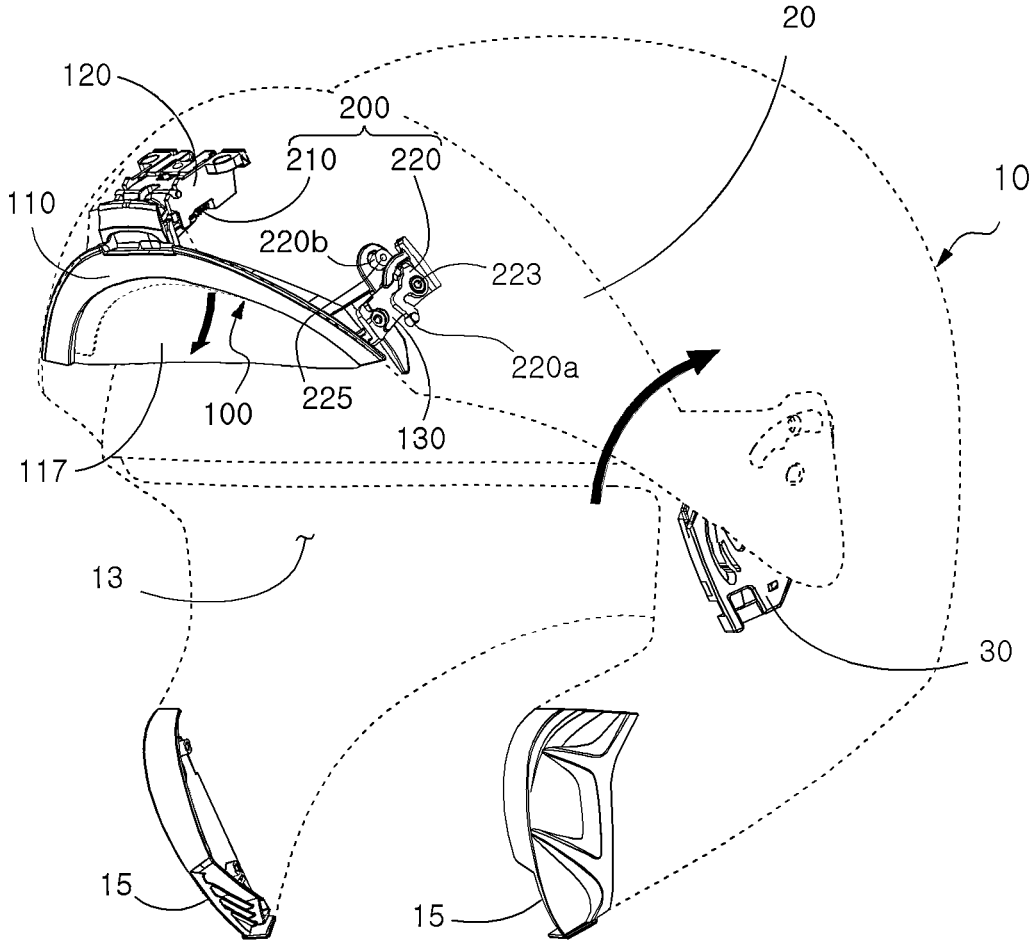
FIG. 9 is a perspective view of a helmet according to an embodiment of the present disclosure.

Meanwhile, as shown in FIG. 9, the chin curtain 100 of the helmet according to this embodiment may further include an extension member 117. Here, the extension member 117 is coupled to the main body 110 and extended toward the wearer. For example, the extension member 117 may be made of cloth, textile, a soft material, etc. When the extension member 117 is coupled to the main body 110, it may be possible to cover the empty space between the chin guard and the wearer's chin or neck.

Although the foregoing description describes that the chin guard 20 is rotatably coupled to the helmet body 10, the scope of protection of the present disclosure is not necessarily limited thereto. The chin guard 20 may be a fixed type to the helmet 10 (for example, a full face helmet). Even in this case, the chin curtain 100 may be rotatably coupled to the chin guard 20 around the rotation axis 115. Accordingly, the chin curtain 100 may rotate with respect to the chin guard 20, thereby preventing the chin curtain 100 from coming into contact with the wearer's body (for example, nose) when the wearer puts on and takes off the helmet body 10. In this instance, an unlatching portion may be used to control the chin curtain 100 by manipulation of the wearer. For example, the wearer may manipulate the unlatching portion to rotate the chin curtain 100 with respect to the chin guard 20 or fix the chin curtain 100 to the chin guard 20.

While the present disclosure has been hereinabove described in detail through the specific embodiments, this is provided to describe the present disclosure in detail, and the present disclosure is not limited thereto, and it is obvious that modifications or changes may be made by those having ordinary skill in the art within the technical spirit of the present disclosure.

Such modifications and changes of the present disclosure fall in the scope of the present disclosure, and the scope of protection of the present disclosure will be apparent from the appended claims.

[Detailed Description of Main Elements]

| | |
|---|---|
| 10: Helmet body | 13: Open portion |
| 15: Outer surface | 20: Chin guard |
| 30: Ratchet | 100: Chin curtain |
| 110: Main body | 115: Rotation axis |
| 117: Extension member | 120: First bracket |
| 130: Second bracket | 200: Controller |
| 210: Elastic member | 220: Rotation control member |
| 220a: First end | 220b: Second end |
| 223: First control axis | 225: Second control axis |
| 300: Stopper | 310: Guide portion |

INDUSTRIAL APPLICABILITY

The present disclosure provides the helmet in which the chin curtain rotates with respect to the chin guard, thereby preventing the chin curtain from coming into contact with the wearer's body (for example, nose).

The invention claimed is:

1. A helmet comprising:

a chin curtain disposed at a chin guard of a helmet body, wherein the chin curtain rotates with respect to the chin guard, wherein the chin guard is rotatably coupled to the helmet body, wherein when the chin guard rotates from a closed position to an open position, the chin curtain rotates with respect to the chin guard, and wherein a rotational direction in which the chin guard rotates with respect to the helmet body from the closed position to the open position while a rotational direction in which the chin curtain rotates with respect to the chin guard are the same.

2. The helmet according to claim 1, wherein the chin curtain includes:

a main body rotatably coupled to the chin guard around a rotation axis; and a controller to rotate the main body in the downward direction when the chin guard rotates from the closed position to the open position.

3. The helmet according to claim 2, wherein the controller includes:

an elastic member to provide an elastic force to the main body to rotate the main body in the downward direction when the chin guard rotates from the closed position to the open position; and a rotation control member to rotate the main body in an upward direction when the chin guard rotates to the closed position.

4. The helmet according to claim 2, wherein the main body is formed in an arc shape.

5. The helmet according to claim 3, wherein when the chin guard rotates to the closed position, the rotation control member comes into contact with an outer surface of the helmet body and rotates the main body in the upward direction.

6. The helmet according to claim 3, wherein the rotation control member is rotatably coupled to the chin guard around a first control axis, and when the chin guard rotates to the closed position, one side of the rotation control member comes into contact with an outer surface of the helmet body, and the other side of the rotation control member is rotatably coupled to the main body around a second control axis to rotate the main body.

7. The helmet according to claim 6, wherein the first control axis is disposed between one side and the other side of the rotation control member.

8. The helmet according to claim 6, wherein when the chin guard rotates to the closed position, one side of the rotation control member comes into contact with the outer surface of the helmet body and moves in the downward direction, and the other side of the rotation control member moves in the upward direction to rotate the main body in the upward direction.

9. The helmet according to claim 3, further comprising:

a stopper to limit a rotation angle of the rotation control member.

10. The helmet according to claim 3, wherein the main body is rotatably coupled to a center of the chin guard, and wherein the rotation control member is rotatably coupled to a location away from the center of the chin guard, and is rotatably coupled to an end of the main body.

11. A helmet comprising:

a chin curtain disposed at a chin guard of a helmet body, wherein the chin curtain rotates with respect to the chin guard, wherein the chin guard is rotatably coupled to the helmet body, wherein when the chin guard rotates from a closed position to an open position, the chin curtain rotates in a downward direction with respect to the chin guard, and wherein the chin curtain includes:

a main body rotatably coupled to the chin guard around a rotation axis; and a controller to rotate the main body in the downward direction when the chin guard rotates from the closed position to the open position, wherein the controller includes:

an elastic member to provide an elastic force to the main body to rotate the main body in the downward direction when the chin guard rotates from the closed position to the open position; and a rotation control member to rotate the main body in an upward direction when the chin guard rotates to the closed position.

12. The helmet according to claim 11, wherein when the chin guard rotates to the closed position, the rotation control member comes into contact with an outer surface of the helmet body and rotates the main body in the upward direction.

13. The helmet according to claim 11, wherein the rotation control member is rotatably coupled to the chin guard around a first control axis, and when the chin guard rotates to the closed position, one side of the rotation control member comes into contact with an outer surface of the helmet body, and the other side of the rotation control member is rotatably coupled to the main body around a second control axis to rotate the main body.

14. The helmet according to claim 13, wherein the first control axis is disposed between one side and the other side of the rotation control member.

15. The helmet according to claim 13, wherein when the chin guard rotates to the closed position, one side of the rotation control member comes into contact with the outer surface of the helmet body and moves in the downward direction, and the other side of the rotation control member moves in the upward direction to rotate the main body in the upward direction.

16. The helmet according to claim 11, further comprising a stopper to limit a rotation angle of the rotation control member.

17. The helmet according to claim 11, wherein the main body is formed in an arc shape.

18. The helmet according to claim 11, wherein the main body is rotatably coupled to a center of the chin guard, and wherein the rotation control member is rotatably coupled to a location away from the center of the chin guard, and is rotatably coupled to an end of the main body.

* * * * *